US009796396B2

(12) United States Patent
Shubs, Jr. et al.

(10) Patent No.: US 9,796,396 B2
(45) Date of Patent: Oct. 24, 2017

(54) TRAIN CONTROL SYSTEM HAVING REMOTE CONFIGURATION INTERFACE

(71) Applicant: Electro-Motive Diesel, Inc., LaGrange, IL (US)

(72) Inventors: Alexander Shubs, Jr., Chicago, IL (US); James David Seaton, Westmont, IL (US); David Matthew Roenspies, Elburn, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 15/047,047

(22) Filed: Feb. 18, 2016

(65) Prior Publication Data

US 2017/0240187 A1 Aug. 24, 2017

(51) Int. Cl.

| | |
|---|---|
| ***B61C 17/12*** | (2006.01) |
| ***B61L 27/00*** | (2006.01) |
| ***B61L 23/00*** | (2006.01) |
| *B61G 5/10* | (2006.01) |
| *B61L 3/12* | (2006.01) |

(52) U.S. Cl.

CPC ..... *B61C 17/12* (2013.01); *B61L 23/00* (2013.01); *B61L 27/00* (2013.01); *B61G 5/10* (2013.01); *B61L 3/127* (2013.01); *B61L 2201/00* (2013.01)

(58) Field of Classification Search

CPC ..... B61C 17/12

See application file for complete search history.

(56) References Cited

U.S. PATENT DOCUMENTS

| | | | | |
|---|---|---|---|---|
| 6,449,536 | B1 | 9/2002 | Brousseau et al. | |
| 6,853,890 | B1 | 2/2005 | Horst et al. | |
| 7,021,588 | B2 | 4/2006 | Hess, Jr. et al. | |
| 7,233,844 | B2 | 6/2007 | Peltz et al. | |
| 7,618,011 | B2 * | 11/2009 | Oleski | B61L 25/025 246/1 C |
| 7,715,956 | B2 * | 5/2010 | Bryant | B60L 15/38 105/26.05 |
| 8,295,992 | B2 | 10/2012 | Ecton et al. | |
| 8,532,842 | B2 | 9/2013 | Smith et al. | |
| 8,538,608 | B2 * | 9/2013 | Meltser | B61C 17/12 246/187 C |
| 8,768,544 | B2 * | 7/2014 | Schroeck | B61C 15/14 701/1 |

(Continued)

*Primary Examiner* — Todd Melton

(74) *Attorney, Agent, or Firm* — Finnegan, Henderson, Farabow, Garrett & Dunner, LLP

(57) ABSTRACT

A control system for remotely facilitating a lead change among a plurality of locomotives in a train is disclosed. The control system may include a user input device, a display device, a communicating device configured to exchange information with the plurality of locomotives, and a controller in electronic communication with the user input device, the display device, and the communicating device. The controller may be configured to generate on the display device a graphical user interface configured to receive a plurality of user inputs in conjunction with the user input device, wherein the plurality of user inputs includes an isolation switch selection, a distributed power selection, and a lead/trail selection. The controller may also be configured to generate configuration commands communicable to the plurality of locomotives via the communicating device based on the user inputs.

18 Claims, 8 Drawing Sheets

(56) References Cited

U.S. PATENT DOCUMENTS

| | | | | |
|---|---|---|---|---|
| 2013/0261842 | A1* | 10/2013 | Cooper | B61L 15/0081 701/1 |
| 2014/0188307 | A1* | 7/2014 | Cooper | B61C 17/12 701/2 |
| 2015/0360700 | A1* | 12/2015 | Cooper | B61C 17/12 701/2 |
| 2016/0229422 | A1* | 8/2016 | Schoenly | B61C 17/12 |

* cited by examiner

TRAIN CONTROL SYSTEM HAVING REMOTE CONFIGURATION INTERFACE

TECHNICAL FIELD

The present disclosure relates generally to a train control system and, more particularly, to a train control system having a remote configuration interface.

BACKGROUND

Trains for transporting rail freight often include a number of coupled railway cars that are pulled along a railroad network by one or more locomotive consists. Locomotive consists include a plurality of locomotives that are linked together for collectively driving a train and can be positioned at a front, middle, or rear location in the train. In general, one of the plurality of locomotives is designated as the lead locomotive, which is controlled by operating personnel and/or an automatic train operation (ATO) system. The remaining locomotives are designated as trailing locomotives, which are operated by or in reliance on instructions provided to the lead locomotive. However, in some situations, the lead locomotive can experience a malfunction that may require the lead locomotive to be operated at a reduced power output or shut down to avoid potential damage. In these situations, managers may wish to reconfigure the other locomotives and designate one of them as the lead locomotive to allow the mission to continue.

When a lead change is desired, certain settings that govern locomotive systems and statuses must be reconfigured based on the nature of the lead change. This process typically requires operators to visit each locomotive of the train and manually actuate many buttons, levers, and switches to reconfigure each locomotive. This process can be time consuming for train operators and can result in costly delays, especially when locomotive consists are positioned throughout a train having several hundred cars. Delays can be exacerbated in situations where an autonomous train experiences a fault with its lead locomotive and is stopped at a location where it may take several hours for personnel to arrive and perform the necessary reconfigurations for a lead change.

A system for remotely controlling the operations of locomotives in a train is described in U.S. Pat. No. 6,449,536 of Brousseau et al. that issued on Sep. 10, 2002 ("the '536 patent"). Specifically, the system described in the '536 patent includes a plurality of locomotives, each having a control module that sends and receives data via an associated communicating device. One of the locomotives is designated as the lead locomotive, which can wirelessly receive a master control signal from an operator and generate local control signals sent wirelessly to other locomotives based on the master control signal. The master control signal may be indicative of a change in the lead operational status, which causes the lead locomotive to relinquish the lead status to another locomotive and assume a trailing status. After a lead change, the new lead locomotive receives the master control signal and generates the local control signals for the other locomotives.

While the system disclosed in the '536 patent may permit for the wireless transmission of master and local control signals among lead and trailing locomotives during operation, it may not be optimum. In particular, the system of the '536 may still require manual reconfiguration of each locomotive in the train during a lead change, which can be burdensome and time consuming. Further, although the system of the '536 patent addresses the transmission of throttle and braking commands during operation of the train, it fails to address commands that may be generated during a lead change.

The disclosed train control system is directed to overcoming one or more of the problems set forth above.

SUMMARY

In one aspect, the present disclosure is directed to a control system for remotely facilitating a lead change among a plurality of locomotives in a train. The control system may include a user input device, a display device, a communicating device configured to exchange information with the plurality of locomotives, and a controller in electronic communication with the user input device, the display device, and the communicating device. The controller may be configured to generate on the display device a graphical user interface configured to receive a plurality of user inputs in conjunction with the user input device, wherein the plurality of user inputs includes an isolation switch selection, a distributed power selection, and a lead/trail selection. The controller may also be configured to generate configuration commands communicable to the plurality of locomotives via the communicating device based on the plurality of user inputs.

In another aspect, the present disclosure is directed to an apparatus for remotely facilitating a lead change among a plurality of locomotives in a train from a remote control device. The apparatus may include a non-transitory computer-readable medium storing computer-readable instructions that, when executed by the processor of the remote control device, cause the processor to generate on a display device associated with the remote control device a graphical user interface configured to receive, in conjunction with a user input device associated with the remote control device, a plurality of user inputs, wherein the plurality of user inputs includes an isolation switch selection, a distributed power selection, and a lead/trail selection. The computer-readable instructions, when executed by the processor of the remote control device, may also cause the processor to generate configuration commands communicable to the plurality of locomotives via a communicating device associated with the remote control device based on the plurality of user inputs.

In yet another aspect, the present disclosure is directed to A control system for remotely facilitating a lead change among a plurality of locomotives in a train. The control system may include a plurality of locomotive control systems, each being associated with one of the plurality of locomotives in the train and configured to control a plurality of locomotive configuration settings, and a remote control device having a user input device a display device, a communicating device configured to exchange information with the plurality of locomotive control systems, and a controller in electronic communication with the user input device, the display device, and the communicating device. The controller may be configured to generate on the display device a graphical user interface configured to receive a plurality of user inputs in conjunction with the user input device, wherein the plurality of user inputs includes an isolation switch selection, a distributed power selection, and a lead/trail selection. The controller may also be configured to generate configuration commands communicable to the plurality of locomotive control systems via the communicating device based on the plurality of user inputs, the configuration commands being indicative of a desired one or more of the plurality of locomotive configuration settings.

DETAILED DESCRIPTION

Figure 1:
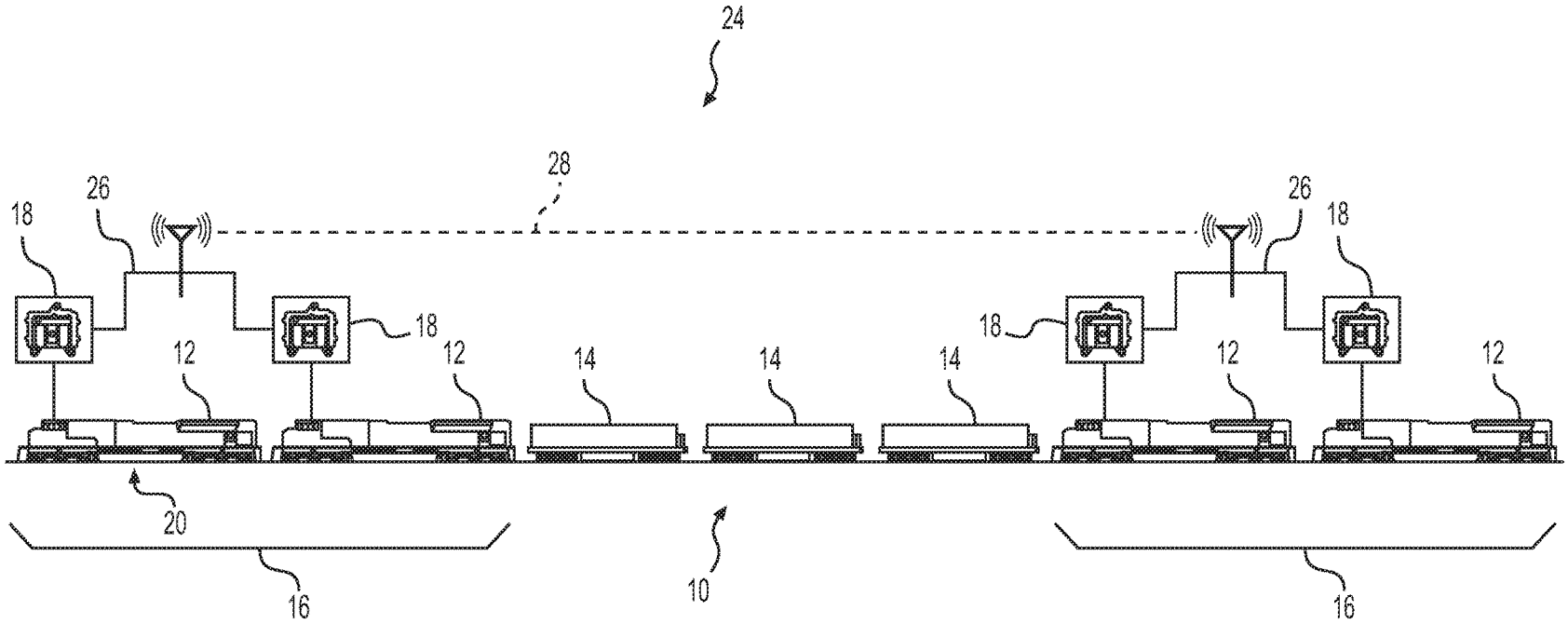
FIG. 1 is a pictorial and schematic illustration of an exemplary disclosed train control system.

FIG. 1 illustrates an exemplary train 10 of coupled rolling stock assets including a plurality of locomotives 12 and a plurality of cars 14. Cars 14 may include, for example, freight cars, tender cars, passenger cars, tanker cars, and/or other types of cars that can be pulled by a train. It is understood that other types of rolling stock assets may be included.

Train 10 may include one or more locomotive consists 16. Each consist 16 may include two or more locomotives 12 directly coupled to each other (i.e., without any intervening cars 14). Consists may be positioned at various locations throughout train 10, such as in a front of train 10 (i.e., ahead of all other rolling stock assets), at an end of train 10 (i.e., behind all other rolling stock assets), or in the middle of train 10 (i.e., between other rolling stock assets).

Locomotives 12 in each consist 16 may be connected to an adjacent locomotive 12 in several different ways. For example, locomotives 12 may be connected to each other via a mechanical coupling, one or more fluid couplings, and one or more electrical couplings for transmitting power and/or data (e.g., data in the form of electrical signals). In one example, the electrical couplings include a multiple-unit (MU) cable configured to transmit conventional command signals and/or electrical power. In another example, the electrical couplings include a dedicated data link configured to transmit packets of data (e.g., Ethernet data). In yet another example, the data packets may be transmitted via the MU cable. It is also contemplated that some data may be transmitted via a combination of the MU cable, the dedicated data link, and/or other means (e.g., wirelessly), if desired.

The plurality of locomotives 12 may each include a locomotive control system 18 configured to control a plurality of locomotive configuration settings and other operational aspects. For instance, each locomotive control system may facilitate manual and/or automatic control of a respective one of the plurality of locomotives 12. To facilitate coordinated control of the plurality of locomotives 12 throughout train 10, one of the locomotives may be designated as a lead locomotive 20, and the consist 16 to which lead locomotive 20 belongs may be designated as a lead consist 22. In some situations, lead consist 22 may be the first consist 16 of train 10 with respect to the directions of travel. In other situations, lead consist 22 may alternatively be in the middle or at the end of train 10. Similarly, lead locomotive 20 may initially be the first locomotive of lead consist 22. In some situations, lead locomotive 20 be initially be in the middle (e.g., when consist 22 includes more than two locomotives) or end of consist 22.

Lead locomotive 20 may be configured to control and/or provide input signals to the other locomotives 12 of train 10 based on commands generated by an operator or an automatic train operation (ATO) system associated with control system 18 of lead locomotive 20. That is, in addition to controlling operations of lead locomotive 20, the control system 18 of lead locomotive 20 may also be configured to control operations of the other locomotives of train 10. Locomotives 12 other than lead locomotive 20 may be referred to as trail locomotives, and consists 16 other than lead consist 22 may be referred to as trail consists. Lead locomotive 20 may control the other locomotives 12 by transmitting to each other locomotive 12 operational commands that are the same as or based on operational commands generated for controlling lead locomotive 20. Operational commands may be transmitted from lead locomotive 20 to other locomotives 12 through a wired and/or wireless communication network 24.

For instance, communication network 24 may include wired connections 26 between locomotives of the same consist. In some embodiments, wired connections 26 may include electrical connections that are part of the coupling between adjacent locomotives 12. Communication network 24 may also or alternatively include a wireless communication system 28 that is configured to communicate information among locomotives 12 in the same or different consists 16. In other embodiments, communication network 24 may include only wired connections 26 or only wireless communication system 28. Wireless communication system 28 may include hardware and/or software configured to provide wireless communication throughout train 10. For example, wireless communication system 28 may utilize WiFi, Bluetooth, cellular, RFID, and/or other wireless communication technologies.

Figure 2:
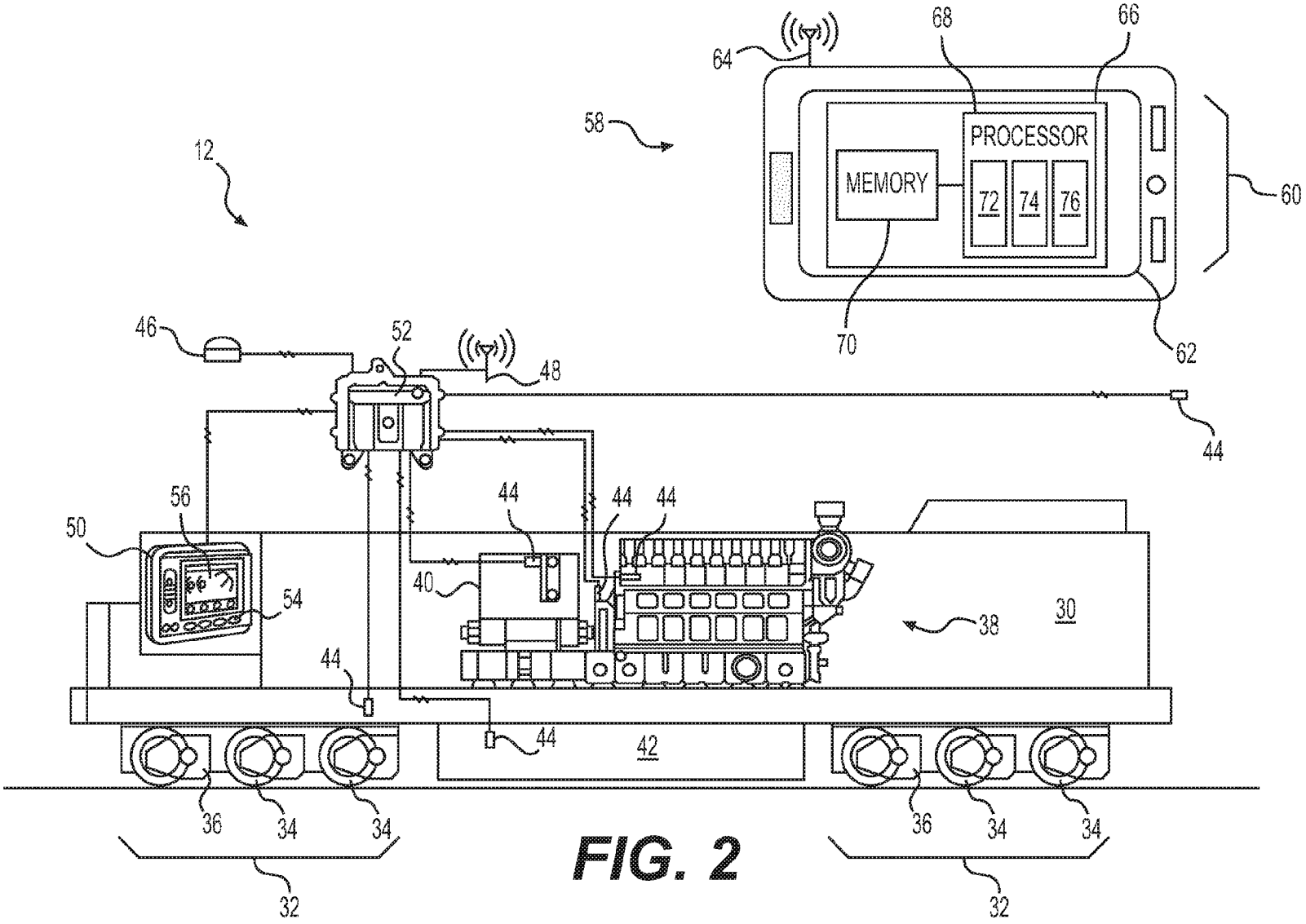
FIG. 2 is a diagrammatic and schematic illustration of an exemplary disclosed locomotive control system that may be included in the train control system of FIG. 1.

As shown in FIG. 2, each locomotive 12 may include a car body 30 supported at opposing ends by a plurality of trucks 32 (e.g., two trucks 32). Each truck 32 may be configured to engage railroad tracks via a plurality of wheels 34, and to support car body 30. Each truck 32 may have two or more axles that are each configured to rigidly support wheels 34 at opposing ends thereof, such that wheels 34 and the axles rotate together. A traction motor 36 may be disposed at a lengthwise center of each axle, connected to an associated truck 32, and configured to drive paired wheels 34 via the axle.

Any number of engines 38 may be mounted to car body 30 and drivingly connected to a generator 40 to produce electricity that propels wheels 34 of each truck 32 via traction motors 36. Engines 38 may be internal combustion engines configured to combust a mixture of air and fuel. The fuel may include a liquid fuel (e.g., diesel) provided to engines 38 from a tank 42 located onboard each locomotive 12, a gaseous fuel (e.g., natural gas) provided by a tender car via fluid couplings, and/or a blended mixture of the liquid and gaseous fuels.

As also shown in FIG. 2, locomotive control system ("control system") 18 may include a network of components configured to monitor operating parameters of locomotive 12 and facilitate manual and/or automatic control of locomotive 12. Control system 18 may include, among other things, at least one sensor 44, a locating device 46, a communicating device 48, a control panel 50, and a controller 52 electrically connected with the other components of control system 18. Signals generated by sensors 44, locating device 46, communicating device 48, and/or control panel 50 may be processed by controller 52 and communicated to an operator of locomotive 12 for manual control or utilized to automatically control locomotive 12.

Any number of sensors 44 may be included within control system 18, each being configured to generate operational data associated with a component train 10. For example, one or more of sensors 44 could be associated with engine 38 and configured to monitor engine parameters, such as a cylinder pressure, an oil pressure, a fuel pressure, a water temperature, an exhaust temperature, an intake air pressure or temperature, a speed, a vibration level, etc., and to generate corresponding signals. In another example, one or more of sensors 44 could be associated with each traction motor 36, with each wheel 34 (e.g., with a bearing of each wheel 34), with generator 40, with tank 42, with coupling components, etc., and configured to generate corresponding pressure signals, temperature signals, speed signals, position signals, or other types of signals indicative of the performances or states of the associated components. When values of the signals generated by sensors 44 deviate from expected values or ranges, the signals may be correlated to a status of the associated component. For example, when the value of a particular signal exceeds or falls below a corresponding threshold value, the associated components may be determined to be malfunctioning. The signals generated by sensors 44 may be directed to controller 52 for further processing.

Locating device 46 may be configured to generate signals indicative of a geographical position and/or orientation of train 10 relative to a local reference point, a coordinate system associated with a region, a coordinate system associated with Earth, or any other type of 2-D or 3-D coordinate system. For example, locating device 46 may embody an electronic receiver configured to communicate with satellites or with a local radio or laser transmitting system and to determine a relative geographical location of itself. Locating device 46 may receive and analyze high-frequency, low-power radio or laser signals from multiple locations to triangulate a relative 3-D geographical position and orientation. Signals generated by locating device 46 may be directed to controller 52 for further processing.

Communicating device 48 may be configured to facilitate data communication between different components (e.g., between sensors 44 and controller 52, between controller 52 and control panel 50, and/or between controller 52 and other components) of control system 18 or between components of control system 18 and entities off-board train 10. Communicating device 48 may also be configured to facilitate communication with other locomotives 12 of the same or a different consist 16 of train 10. Communicating device 48 may include hardware and/or software that enable the sending and/or receiving of data messages through a communications link. The communications link may include satellite, cellular, infrared, WiFi, Bluetooth, radio, or any other type of wireless communication technology. Alternatively, the communications link may include electrical, optical, or any other type of wired communications, if desired. In one embodiment, control panel 50 and/or controller 52 may be located off-board train 10, and may communicate directly with the other onboard components of control system 18 via communicating device 48, if desired. Other means of communication may also be possible.

Control panel 50 may be an interface system located at or near an operator station of locomotive 12 and configured to facilitate manual observation and control of locomotive 12. Control panel 50 may include one or more input devices 54 configured to receive user inputs for controlling operations of locomotive 12. Input device 54 may include one or more components, such as buttons, knobs, switches, dials, levers, touch-screens, soft keys, a keyboard, a mouse, and/or other components configured to allow a user to provide inputs to or operate an electronic device. In some embodiments, control panel 50 may include separate input devices 54 for controlling each of a plurality of operational settings associated with, for example, uncouplers, lights, brake systems, isolation functions, engine start and stop functions, distributed power functions, lead change functions, and/or other aspects.

In other embodiments, input devices 54 may be associated with an electronic interface associated with control panel 50 that is configured to receive multiple different inputs via the same input devices 54 in connection with a display device 56. Display device 56 may be a liquid crystal display (LCD), a cathode ray tube (CRT), a personal digital assistant (PDA), a plasma display, a touch-screen, a portable hand-held device, or any such display device known in the art. Display device 56 may be configured to display graphical user interfaces (GUI) and graphical objects related to locomotive control (e.g., graphical gauges and indicators, graphical versions of input devices 54, etc.) and generated by controller 52.

Controller 52 may embody a single microprocessor or multiple microprocessors that include a means for operating and/or controlling control system 18 based on information obtained from any number of train components via sensors 44, from locating device 46, from communications received via communicating device 48, and/or from control panel 50. Numerous commercially available microprocessors can be configured to perform the functions of controller 52. Controller 52 may include a memory, a secondary storage device, a processor, and any other components for running an application. The memory may include a non-transitory computer-readable medium, such as RAM, ROM, FLASH memory, CD ROM, magnetic devices (e.g., disks, tape, etc.), and/or other types of memory. Various other circuits may be associated with controller 52 such as power supply circuitry, signal conditioning circuitry, solenoid driver circuitry, and other types of circuitry.

At the beginning of a mission, one of locomotives 12 (referring to FIG. 1) may be initially designated and configured as lead locomotive 20, and the remaining locomotives 12 may be designated and configured as trail locomotives. As mentioned above, the control system of lead locomotive 20 may also control or supply control signals to the control system 18 of each trail locomotive to allow locomotives 12 to work together (i.e., in coordination) to efficiently drive train 10. A locomotive's designation as a lead or trail locomotive is referred to herein as a lead/trail designation. Each locomotive 12 may be configured as a lead or trail locomotive by ensuring certain controls are adjusted to particular settings that cause the locomotive 12 to perform as a lead or trail locomotive. Controls for configuring locomotive 12 as a lead or trail locomotive may be set from control panel 50 via input devices 54. However, when a lead change is desired, it may be time consuming for personnel to visit the control panel 50 of each locomotive 12 in each consist 16 of train 10 (referring to FIG. 1) to perform lead change configurations.

To help facilitate locomotive reconfigurations during a lead change, control system 18 may be configured to communicate with a remote control device 58 located off-board train 10 and configured to allow a manager or other personnel to remotely adjust locomotive controls for performing lead changes. That is, remote control device 58 may be configured to allow users to adjust all or some of the controls typically adjustable from control panel 50 (i.e., via input devices 54 of control panel 50) from remote locations to facilitate rapid lead changes. For instance, when lead locomotive 20 (referring to FIG. 1) experiences a fault, error, or other malfunction (e.g., as determined by controller 52 in conjunction with sensors 44) that requires a lead change, a manager may be able to access the control system 18 of each locomotive 12 in train 10 and reconfigure each locomotive 12 (i.e., adjust associated control settings) as a lead or trail locomotive using virtual input devices provided by remote control device 58.

As also shown in FIG. 2, remote control device 58 may include a user input device ("input device") 60 configured to receive user inputs, a display device 62, and a communicating device 64 configured to exchange information (i.e., electronic signals) with the control system 18 of each locomotive 12. Remote control device 58 may be a computing device, such as a computer (e.g., a desktop computer, laptop computer, etc.), a tablet, a cellular phone, a personal digital assistant (PDA), or a dedicated computing device, and may be configured for stationary or mobile use. In this way, a user may be able to access each locomotive 12 of train 10 remotely from a personal computer, such as a desktop computer located in an office, a laptop computer used by personnel in the field or at a remote office, or a personal hand-held device used by personnel in the field or from any location where network connectivity can be obtained. It is noted that other types of electronic devices may be used from other locations, as desired.

Input device 60 include one or more components, such as buttons, knobs, switches, dials, levers, touch-screens, soft keys, a keyboard, a mouse, and/or other components configured to allow a user to provide inputs to or operate an electronic device. Display device 62 may be a liquid crystal display (LCD), a cathode ray tube (CRT), a plasma display, a touch-screen, a portable hand-held device, or any such display device known in the art. Display device 62 may be configured to display graphical user interfaces (GUI) and graphical objects related to locomotive control (e.g., graphical gauges and indicators, graphical versions of input devices 54, etc.). Communicating device 64 may include hardware and/or software that enable the sending and/or receiving of data messages through a communications link. The communications link may include satellite, cellular, infrared, WiFi, Bluetooth, radio, or any other type of wireless communication technology. Alternatively, the communications link may include electrical, optical, or any other type of wired communications, if desired.

Remote control device 58 may include a controller 66 having a processor 68 and memory 70. Although controller 66 is shown in FIG. 2 as being internal to remote control device 58, it is understood that one or more components of controller 66 may alternatively be contained within a housing that is separate from input device 60, display device 62, and/or communicating device 64. For example, memory 70 may be located away from remote control device 58 (e.g., within a remote server, computer, or other electronic device) and accessible by processor 68 via communicating device 64 or other means of data transfer. Although a single processor 68 is shown in FIG. 2, controller 66 may include multiple processors. Processor 68 may include a means for remotely operating and/or controlling control system 18 of locomotive 12 based on information (i.e., inputs) received from input device 60. Numerous commercially available microprocessors can be configured to perform the functions of processor 68. In one exemplary embodiment, processor 68 may include an input module 72 for receiving inputs from hardware devices (e.g., input device 60), a display module 74 for displaying graphical images on display device 62, and a communications module 76 for communicating information (e.g., electronic signals) via communicating device 64. As used herein, the term "module" may refer to hardware, software, or combinations thereof that are configured to facilitate receiving, processing, and or transmission of electronic signals. Various other circuits may be associated with controller 66, such as power supply circuitry, signal conditioning circuitry, solenoid driver circuitry, and other types of circuitry Memory 70 may include one or more types of non-transitory computer-readable medium, such as RAM, ROM, FLASH memory, CD ROM, magnetic devices (e.g., disks, tape, etc.), and/or other types of memory. Memory 70 may store computer-readable instructions that, when executed by processor 68 of remote control device 58, cause processor 68 to generate on display device 62 a graphical user interface (GUI) 78 (shown in FIGS. 3-7) configured to receive, in conjunction with input device 60, a plurality of user inputs. The computer-readable instructions stored in memory 70 may also, when executed by processor 68, cause processor 68 to generate configuration commands communicable to the plurality of locomotives 12 (referring to FIG. 1) via communicating device 64 based on the user input.

Figure 3:
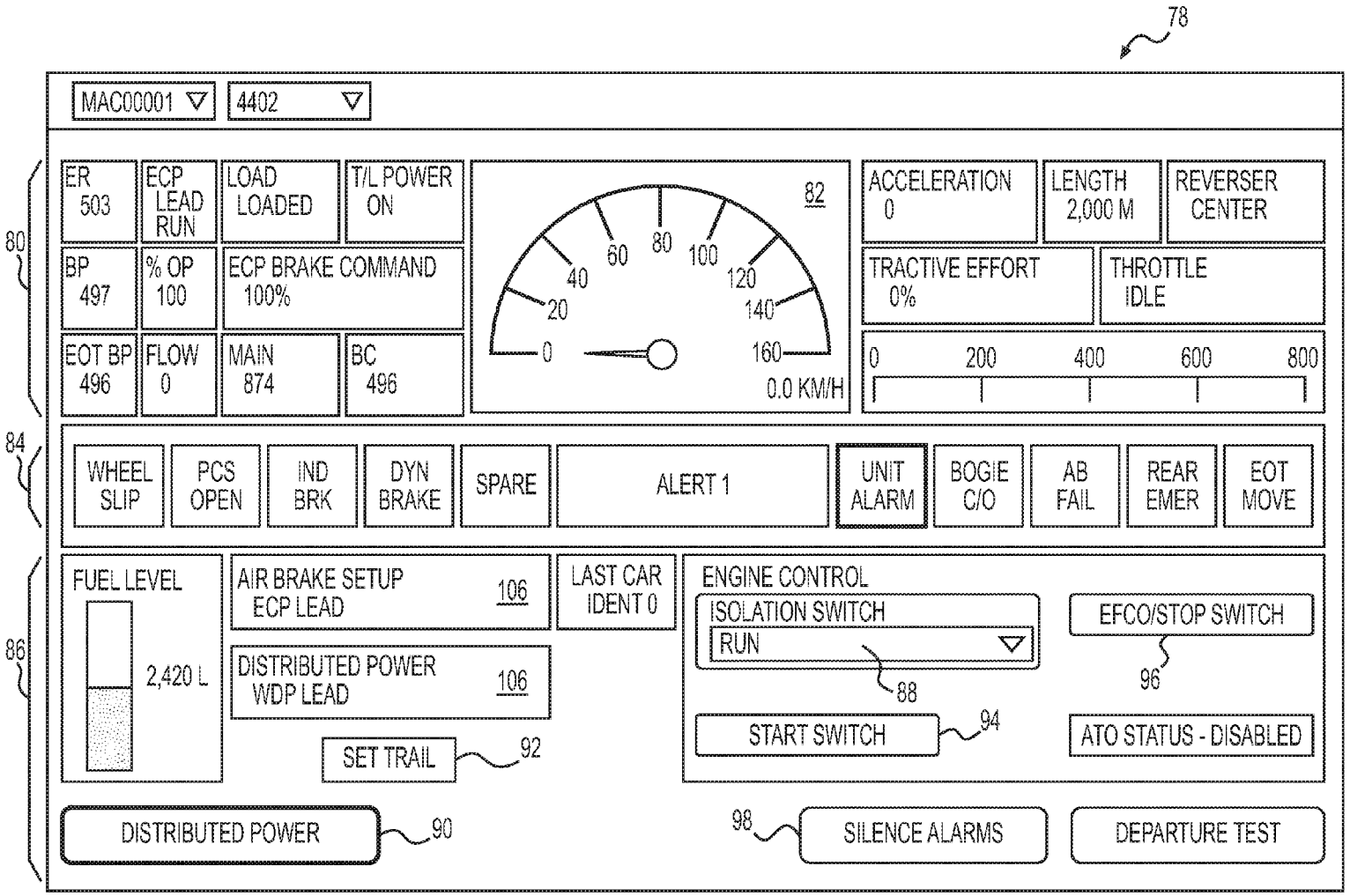
FIG. 3 is an exemplary graphical user interface that may be used in conjunction with the train control system of FIG. 1.

As shown in FIG. 3, GUI 78 may include a plurality of graphical objects configured to convey information relating to locomotive 12 (referring to FIG. 2) or to facilitate the receiving of user inputs via input device 60. For example, GUI 78 may include a plurality of informational objects 80, each being indicative of an operational aspect of locomotive 12. Informational objects 80 may include virtual gauges, status indicators, control setting readouts, and or other indicators. In an exemplary embodiment, GUI 78 may include a graphical speedometer 82 indicative of a speed of locomotive 12. Other graphical gauges may be included to convey other or additional information, such as pressures, voltages, temperatures, fuel levels, timers, etc. Operational aspects of locomotive 12 that may be indicated by informational objects 80 may include, for example, a load status, a power status, a brake system status, an acceleration, a train length, a reverser position, a tractive effort, a throttle position (e.g., idle, T1-T8, etc.), and/or other operational aspects.

GUI 78 may also include one or more alert objects 84 indicative of errors, faults, failures, malfunctions, etc., associated with systems or components of locomotive 12 and/or train 10. For example, when control system 18 (referring to FIG. 2) detects a fault, the fault may be communicated to controller 66, and processor 68 may be configured to indicate one or more fault details, via alert objects 84. Alert object 84 may be indicative of faults, statuses, and/or other alerts relating to, for example, traction (e.g., wheel slip, traction motors 36, etc.), brake systems (e.g., independent, dynamic, automatic, air brakes, etc.), engine functions, generators, and/or other components and operational aspects.

GUI 78 may also include a plurality of control objects 86 configured to facilitate the receiving of user inputs in conjunction with input device 60, such as for receiving user inputs for remotely performing a locomotive lead change. For example, control objects 86 may include an isolation switch object 88 for receiving an isolation switch selection, a distributed power object 90 for receiving a distributed power selection, and a lead/trail object 92 for receiving a lead/trail selection. GUI 78 may include other graphical objects for receiving other user inputs, such as a start witch object 94 for starting engines 38, an emergency fuel cut off (EFCO)/stop switch object 96 for cutting off fuel to engines 38, and a silence alarms object 98 for silencing alarms during the lead change process.

Isolation switch object 88 may be configured to provide a plurality of isolation switch settings that may be selectable by the user in conjunction with input device 60 of remote control device 58. For example, the plurality of isolation switch settings may include an "isolate" setting, a "run" setting, and a "dynamic brake only" setting. It is understood that fewer, additional, or other settings may be included as isolation switch settings. The "isolation" setting may be selected whenever engine 38 is to be started. In some embodiments, start switch object 94 may be effective (i.e., selectable) only when "isolation" is selected. However, EFCO/stop switch object 96 may be always be effective for stopping engine 38 when selected. The "isolate" setting may also be used to isolate locomotive 12 so locomotive 12 will not develop power or respond to certain controls (e.g., throttle controls, brake controls, etc.). For instance, when the "isolation" setting is selected, engine 38 may run at idle speed regardless of throttle control position. Selection of the "isolate" setting may also silence certain audible alarms in the event of a no power alter, low lube oil alert, or other type of alert is generated. If locomotive 12 is equipped with a remote traction motor cutout switch, GUI 78 may include a cutout switch object that may only be effective when the "isolate" setting is selected.

After engine 38 has been started, locomotive 12 can be placed "on the line" by selecting the "run" setting of isolation switch object 88. Locomotive 12 may respond to all controls and develop power for performing normal operations when the "run" setting is selected. When other settings are selected, locomotive 12 may be permitted to respond to certain controls associated with those settings. For example, when the "dynamic brake only" setting is selected, locomotive 12 may be permitted to respond to dynamic brake commands, but not permitted respond to other control commands. It is understood that other settings may be made available for selection through isolation switch object 88, if desired.

Isolation switch object 88 may include graphical features configured to facilitate the selection of an isolation switch setting. For example, isolation switch object 88 may be a dropdown menu containing a list of selectable settings. Alternatively, isolation switch object 88 may include a plurality of buttons, check boxes, graphical dials or selectors, or a command line interface configured to provide selectable settings or allow the user to otherwise select an isolation switch setting. Other forms of isolation switch object 88 may be possible.

Distributed power object 90 may be configured to provide a plurality of distributed power settings that may be selectable by the user in conjunction with input device 60 of remote control device 58. For example, the plurality of distributed power settings may include a first setting corresponding to a desire to enter a "distributed power lead mode" and a second setting corresponding to a desire to exit the "distributed power lead mode." Selection of the distributed power "lead mode" may designate locomotive 12 (referring to FIG. 2) as lead locomotive 20 (referring to FIG. 1). That is, selection of the distributed power "lead mode" may result in control system 18 of locomotive 12 being configured to control or provide control signals to other locomotives 12 of train 10 for controlling, among other things, traction (i.e., throttle), braking, and/or other operational aspects.

Figure 4:
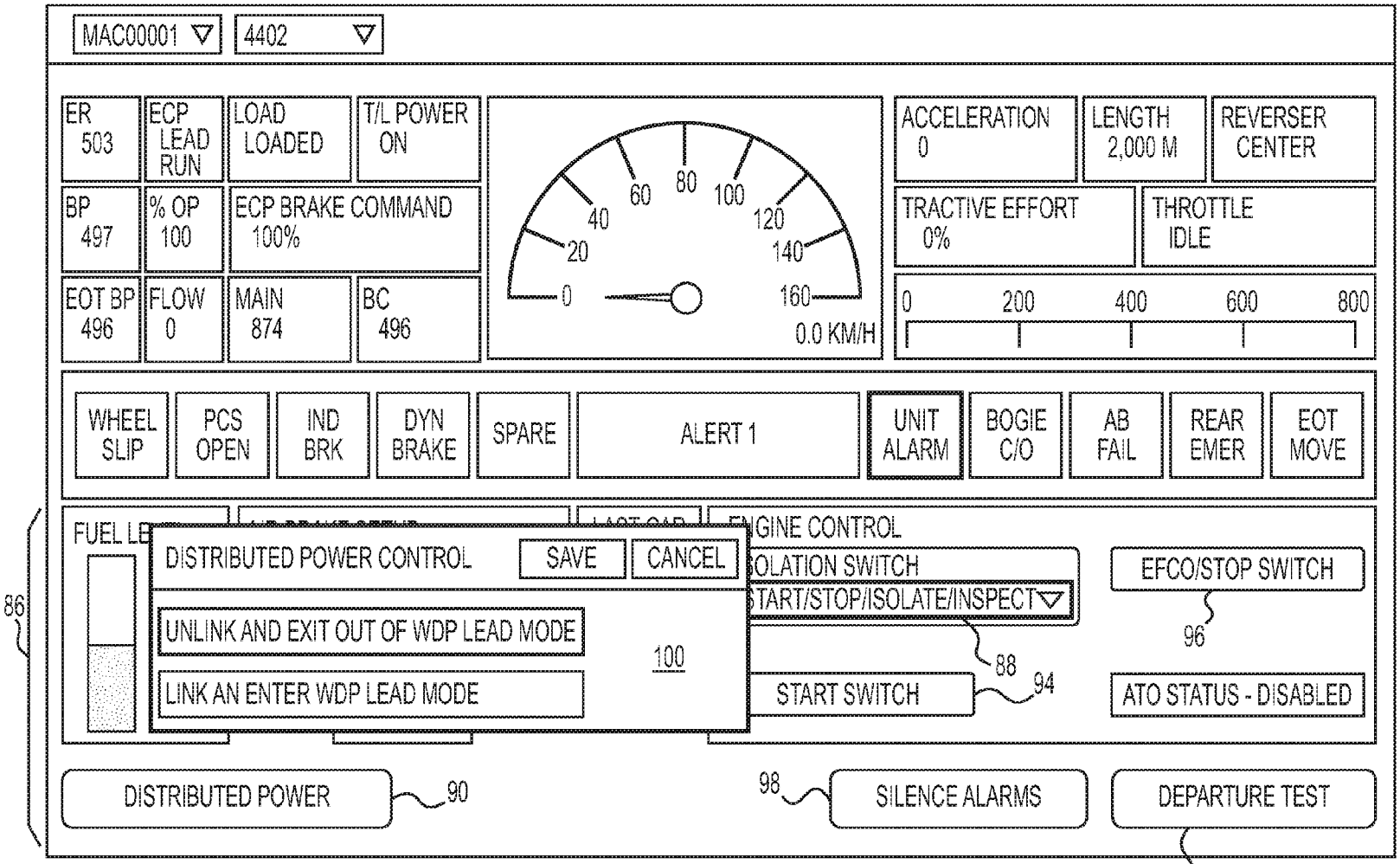
FIG. 4 is an exemplary graphical user interface that may be used in conjunction with the train control system of FIG. 1.

In one example, distributed power object 90 may be a graphical button that, when selected, causes a secondary object 100 associated with distributed power object 90 to be generated on GUI 78, as shown in FIG. 4. Secondary object 100 may include selection objects (e.g., graphical buttons) that may be selected by the user for making a distributed power setting selection. In other embodiments, distributed power object 90 may alternatively include a plurality of separate graphical objects, each representing a different distributed power setting selectable by the user. In other exemplary embodiments, distributed power object 90 may include check boxes, graphical dials or selectors, or a command line interface configured to provide selectable settings or allow the user to otherwise select a distributed power setting. Other forms of distributed power object 90 may be possible.

Lead/trail object 92 may be a graphical object configured to receive a command from the user to commence reconfiguration of locomotive 12 as a lead or trail locomotive. That is, a selection of lead/trail object 92 by the user in conjunction with input device 60 may be indicative of a request for control system 18 to be reconfigured as a lead or trail locomotive. For example, when lead/trail object 92 is selected, command signals may be generated by processor 68 and communicated to control system 18 based on the other user inputs received in conjunction with GUI 78, such as the selected isolation witch setting and the distributed power setting.

Figure 5:
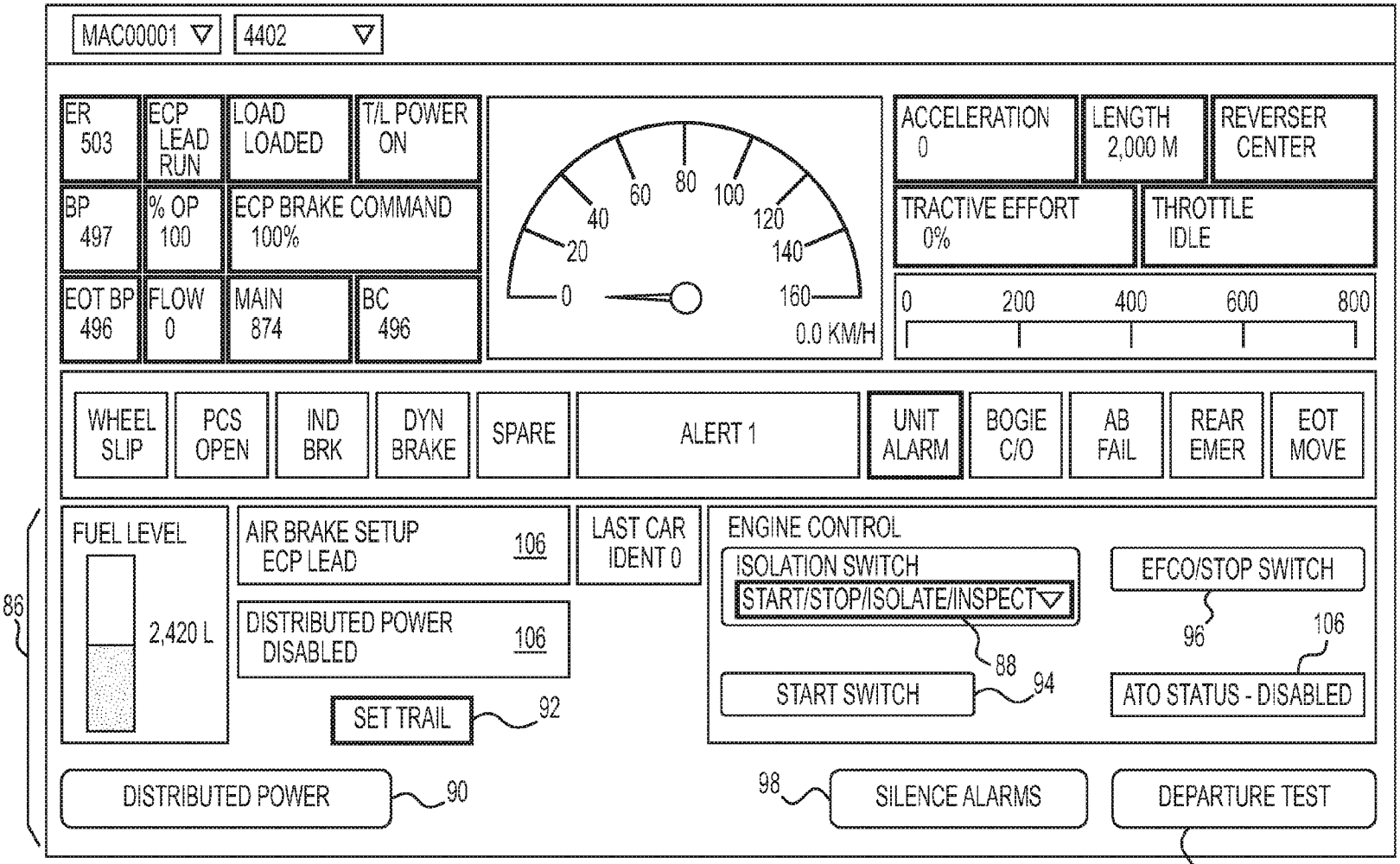
FIG. 5 is an exemplary graphical user interface that may be used in conjunction with the train control system of FIG. 1.
Figure 6:
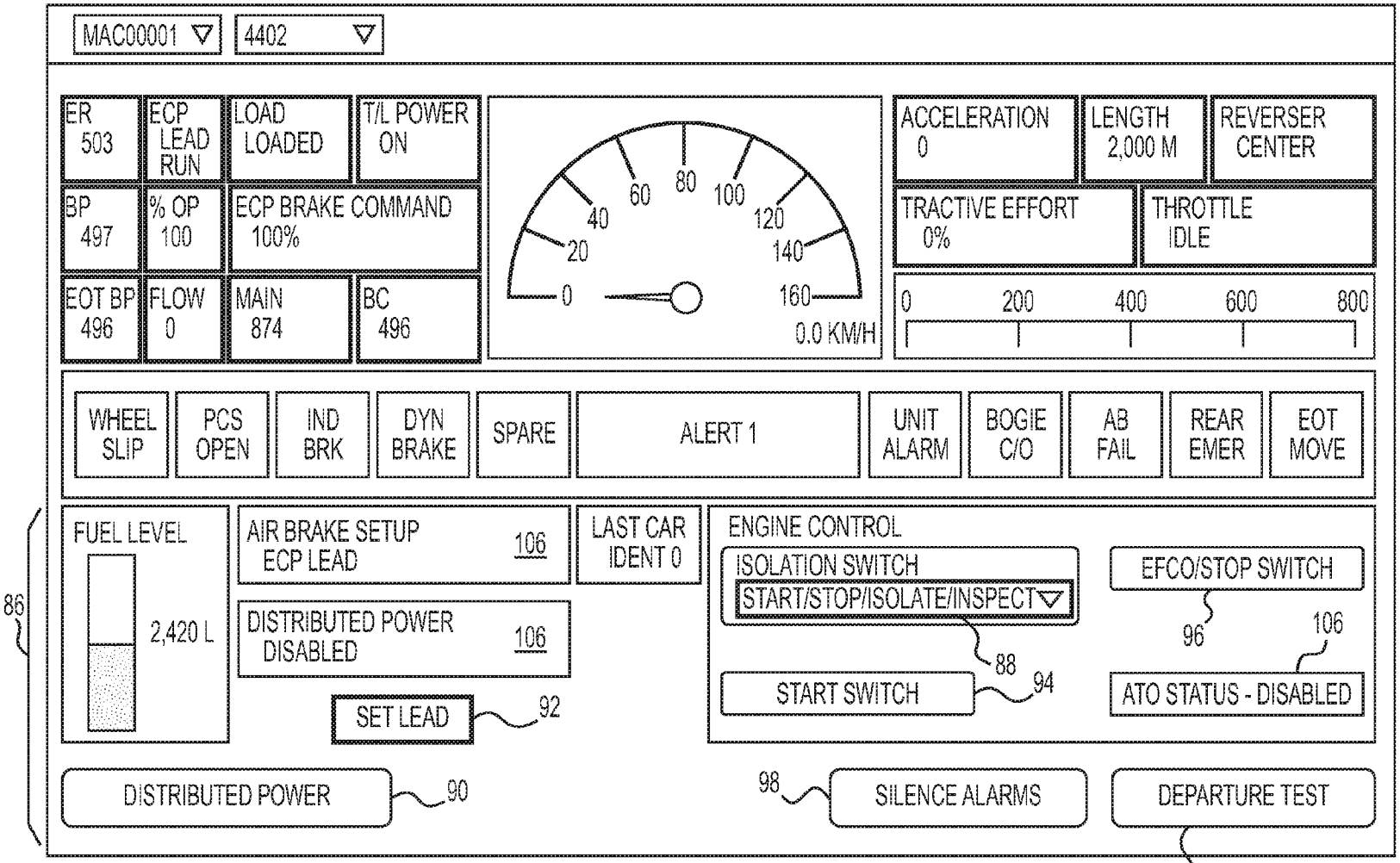
FIG. 6 is an exemplary graphical user interface that may be used in conjunction with the train control system of FIG. 1.

Lead/trail object 92 may be, for example, a graphical button that includes indicia representing the nature of a lead change request that will be requested upon it being selected. For instance, lead/trail object 92 may display text such as "set trail" when locomotive 12 is currently designated as a lead locomotive or "set lead" when locomotive 12 is currently designated as a trail locomotive, as shown in FIGS. 5 and 6. Controller 66 (referring to FIG. 2) may be configured to selectively toggle lead/trail object 92 between providing the selectable "set trail" option and providing the selectable "set lead" option. That is, the function of lead/trail object 92 may be automatically changed when locomotive 12 is reconfigured from lead to trail or from trail to lead, such that the function and text associated with lead/trail object 92 reflects the opposite lead/trail designation of the current designation of locomotive 12.

In other embodiments, lead/trail object 92 may alternatively include a plurality of separate graphical objects, each representing a different lead/trail designation selectable by the user. In other exemplary embodiments, lead/trail object 92 may include check boxes, graphical dials or selectors, or a command line interface configured to provide selectable settings or allow the user to otherwise select a lead/trail designation. In some such embodiments, graphical objects representing the current lead/trail designation of locomotive 12 may be dormant (i.e., not selectable), and objects representing other lead/trail designations may be active for selection. The dormant or active status of each object may be automatically changed when the lead/trail designation of locomotive 12 is changed. Other forms of lead/trail object 92 may be possible.

GUI 78 may further include a departure test object 102 for initiating a departure test prior to restarting operation of locomotive 12. Departure test object 102 may be a graphical object that corresponds to a desire to initiate a departure test. That is, departure test object 102 may be selectable in conjunction with input device 60, and a selection of departure test object 102 may be indicative of a desire to initiate the departure test. Selection of departure test object 102 may be recognized by processor 68 (e.g., via a input device 60) and initiate a departure test. A departure test may refer to a test performed by controller 66 and/or control system 18 of locomotive 12 to determine a state or condition of locomotive 12 or its components, (e.g., engine components, electrical components, components of control system 18, etc.).

For example, the departure test may be used to determine whether locomotive 12 is ready to be successfully controlled manually or by an associated ATO system. Successful manual or automatic control may depend on the state or condition of one or more locomotive hardware or software aspects. For instance, successful control may depend on whether any or certain active faults, failures, or alerts are detected by control system 18. Whether locomotive 12 passes the departure test may vary depending on whether locomotive 12 has been configured as lead or trail locomotive. That is, the departure test results may indicate a failed test for locomotive 12 when locomotive 12 is configured as a lead locomotive, but may indicate that locomotive 12 has passed the departure test when locomotive 12 is configured as a trail locomotive. It is understood that the departure test may include other or additional determinations.

In one embodiment, selection of departure test object 102 may cause the generation of a test result object 104 on GUI 78. Test result object 104 may be a graphical object indicative of the result of a departure test initiated by the selection of departure test object 102. Test result object 104 may indicate, for example, whether locomotive 12 passed or failed the departure test. In some embodiments, test result object 104 may indicate a reason or a code indicative of a reason why locomotive 12 failed the departure test. Test result object 104 may be a part of or separate from departure test object 102.

GUI 78 may also include one or more status objects 106 indicative of a locomotive system status. For example, during reconfiguration of locomotive 12, the user may wish to know an ATO status, brake system status, distributed power status, or another status associated with locomotive 12, and status objects 106 may be indicative of this information. Status objects 106 may be graphical objects that include indicia, such as text, symbols (e.g., graphical images, blinking lights, etc.), or other indicia of a locomotive system status. Status objects 106 may be automatically updated as selections of other objects on GUI 78 are made during the reconfiguration process and/or as control system 18 detects changes in the status of locomotive systems. That is, controller 66 may be configured to automatically update status objects 106 based on actual changes to the status of a locomotive control system. Changes to the status of a locomotive control system may result from the reconfiguration of locomotive 12. For example, the ATO status of locomotive 12 may change based on user inputs, such as selections made via isolation switch object 88. Thus, controller 66 may be configured to automatically update the locomotive system status indicated by each of the one or more status objects based on the user inputs.

To allow the user to switch between different locomotives 12 of train 10, GUI 78 may include a locomotive selection object 108 configured to receive a selection of one of the plurality of locomotives 12 in conjunction with input device 60. Locomotive selection object 108 may include graphical features configured to facilitate the selection or entry of an a locomotive. For example, locomotive selection object 108 may be a dropdown menu containing a list of selectable locomotives associated with train 10. Locomotives may be selectable from the list in conjunction with input device 60. Alternatively, locomotive selection object 108 may include a plurality of buttons, check boxes, graphical dials or selectors, or a command line interface configured to provide for a locomotive selection or allow the user to otherwise enter a selected locomotive. Other forms of locomotive selection object 108 may be possible. Configuration commands may be sent to one of locomotives 12 based on user selections made via locomotive selection object 108. That is, controller 66 may be configured to communicate configuration commands generated via GUI 78 to the selected one of the plurality of locomotives 12 via communicating device 64.

In some embodiments, remote control device 58 may be configured to allow the user to reconfigure locomotives associated with different trains. To facilitate a selection of a desired train for locomotive reconfiguration, GUI 78 may include a train selection object 110 configured to receive a selection of one of a plurality of trains in conjunction with input device 60. Train selection object 110 may include graphical features configured to facilitate the selection or entry of a desired train. For example, train selection object 110 may be a dropdown menu containing a list of selectable trains. Trains may be selectable from the list in conjunction with input device 60. Alternatively, train selection object 110 may include a plurality of buttons, check boxes, graphical dials or selectors, or a command line interface configured to provide for a train selection or allow the user to otherwise enter a selected train. Other forms of train selection object 110 may be possible. Locomotives selectable via locomotive selection object 108 may depend or be based on a train selected via train selection object 110. That is, controller 66 may be configured to populate locomotive selection object 108 with selectable locomotives based on a user input (i.e., a train selection) received via train selection object 110.

Figure 8:
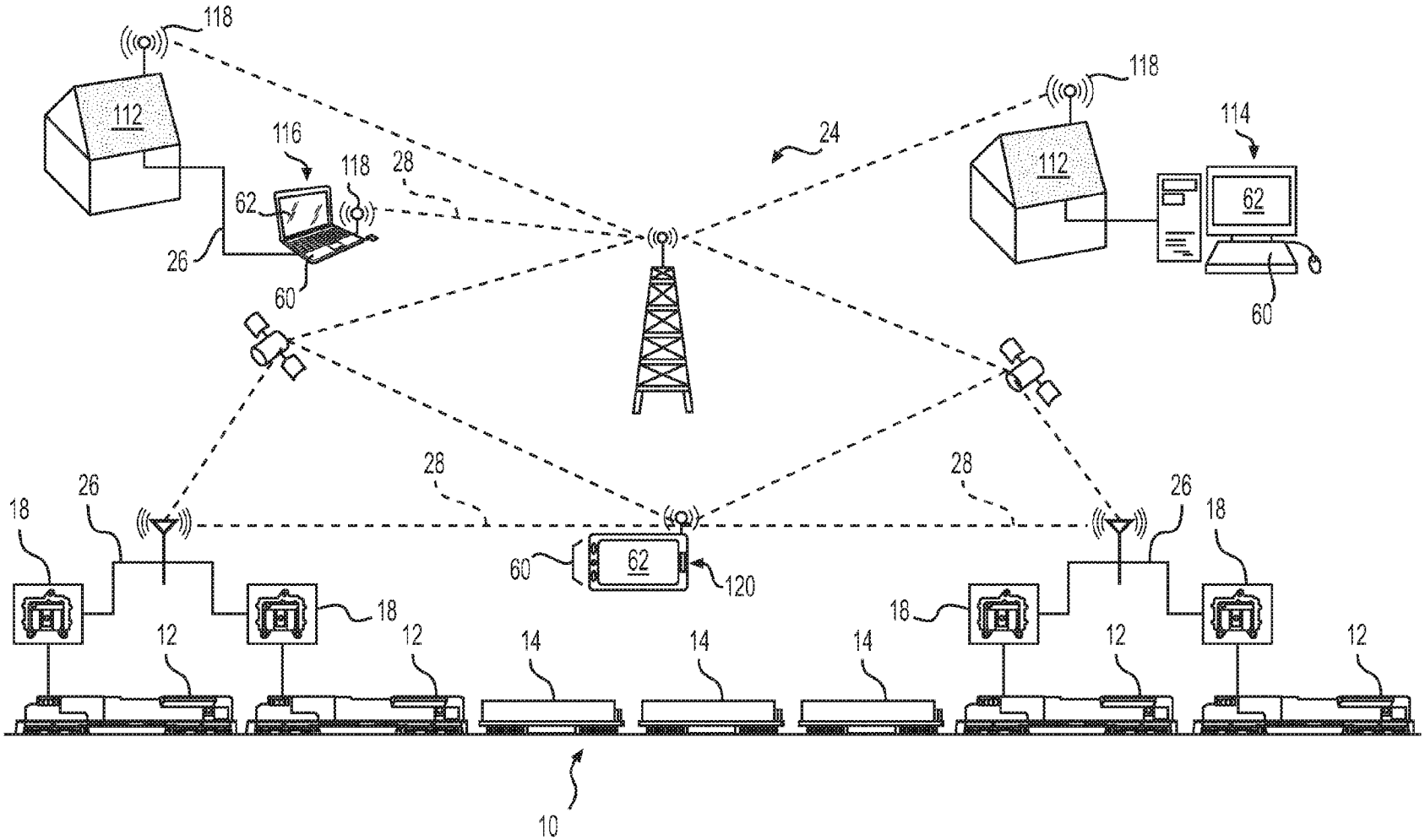
FIG. 8 is a pictorial and schematic illustration of another exemplary disclosed train control system.

It is noted that GUI 78 may be accessible via any type of electronic device, configured or configurable to display graphical images and facilitate user interactions with graphical images via an associated input device. For example, as shown in FIG. 8, a user located in an office 112 may be able to access each locomotive 12 of train 10 from a personal computer, such as, for example, a desktop computer 114 or a laptop computer 116. Computers 114, 116 may be configured to exchange data with each locomotive 12 via communication network 24. For instance, each computer 114, 116 may include or be connected to a communication device 118 configured to allow information to be communicated via communication network 24 to each locomotive 12. Communication device 118 may be configured to facilitate communication from an office or other location via a wired or wireless connection via communication network 24. Communication network 24 may include dedicated network components and/or public network components, such as public telephone, cable, internet, cellular, radio, satellite, and or other types of networks.

It is to be understood that other types of computing devices may also or alternatively be used to access and remotely configure locomotives 12. For example, hand-held devices 120 (e.g., PDAs, cellular phones, tablets, dedicated devices, etc.) that are configured to send and receive data via a wired or wireless communication networks, including WiFi, Bluetooth, RFID, cellular networks, cable networks, satellite networks, etc., may be used to access each locomotive 12 via GUI 78 while personnel is located in an office, on train 10, or anywhere in between where communication network 24 can be accessed.

INDUSTRIAL APPLICABILITY

The disclosed control system can be applicable to any train that includes multiple locomotives that collectively operate to drive the train and in which one of the locomotives is designated as a lead locomotive that could malfunction during a mission. The disclosed control system may provide a way to quickly and remotely access and reconfigure a control system of each locomotive in the train in order to facilitate a lead change after the lead locomotive has malfunctioned. Specifically, the disclosed control system may allow a user to reconfigure locomotive control settings, which are normally accessible from an onboard control panel, from remote locations via a remote control device. The disclosed system may also allow users to quickly and easily switch between locomotives of a train and adjust locomotive control settings required to fully perform a locomotive lead change. An exemplary operation of a control system consistent with the present disclosure will now be discussed.

At the beginning of a mission, one of locomotives 12 (referring to FIG. 1) of train 10 may be initially designated and configured as lead locomotive 20, and the remaining locomotives 12 may be designated and configured as trail locomotives. During operation, control system 18 of lead locomotive 20 may control or supply control signals to the control system 18 of each trail locomotive to allow all of locomotives 12 to work together (i.e., in coordination) to efficiently drive train 10. When control system 18 of lead locomotive 20 detects a fault (e.g., via sensors 44 in conjunction with controller 52) and the detected fault requires control system 18 to control lead locomotive 20 using control strategies other than control strategies used during normal operation (i.e., operation without active faults), a locomotive lead change may be required to allow train 10 to complete its mission or to expediently move to where it can be serviced. The lead change may require lead locomotive 20 to be reconfigured as a trail locomotive, and one of the trail locomotives to be reconfigured as the lead locomotive, which may be performed via remote control device 58 (referring to FIG. 2).

For example, the user may log into an on-device application, a web-based application, or another type of program stored in or accessible through controller 66. The program may be accessed via a personal computer, such as a desktop computer 114, laptop computer 116, or handheld device 120 (referring to FIG. 8). In this way, the user may be able to access each locomotive 12 from any location where a connection to communication network 24 is available. This may allow each locomotive 12 to be reconfigured from remote locations (e.g., an office, a moving vehicle, a user's home, etc.) without having to dispatch personnel to train 10, thereby allowing for reconfigurations to be carried out quickly with minimal delay. It is understood, however, that personal computers (e.g., desktop computer 114 and laptop computer 116) and handheld devices 120 may also be configured or configurable for use in the field (e.g., on or near train 10) to allow users to remotely access and reconfigure each locomotive 12 via GUI 78. For example, computers 114, 116 and handheld devices 120 may be configured to communicate via communications network 24 or directly with each locomotive 12 when in the proximity of train 10. In this way, a user on or near train 10 may be able to reconfigure each locomotive without having to physically visit each locomotive, thereby reducing the time needed for personnel to reconfigure each locomotive 12.

The user may select which of locomotives 12 to reconfigure by selecting or otherwise entering a name, ID number, or other indicia of a locomotive 12 via locomotive selection object 108 (referring to FIG. 7) on GUI 78. For example, controller 66 of remote control device 58 may generate GUI 78 on display device 62, and the user may use input device 60 to make a locomotive selection using locomotive selection object 108 of GUI 78. When multiple trains are available for management, the user may also select a desired train (e.g., a name, ID number, or other indicia of the train) via train selection object 110, prior to selecting a locomotive.

For instance, the user may first select lead locomotive 20 to reconfigure it as a trail locomotive. After selecting lead locomotive 20, the user may observe current operating parameters of lead locomotive 20 via informational objects to ensure lead locomotive 20 is in a proper state of function to undergo a lead change. The user may also observe whether and/or what kind of fault has necessitated the lead change via alert objects 84. If engine 38 is not already stopped, the user may select EFCO/stop switch object 96 on GUI 78 using input device 60 to stop engine 38, as needed. The user may then isolate lead locomotive 20 by changing the isolation switch setting of lead locomotive 20 to "isolate" or another setting designated for an isolation mode (e.g., "start/stop/isolate/inspect") via isolation switch object 88 using input device 60 of remote control device 58. In this way, lead locomotive 20 may be prevented from responding to inputs made via input devices on its control panel 50.

The user may then select a distributed power setting via distributed power object 90 on GUI 78 using input device 60 of remote control device 58. For instance, the user may select distributed power object 90 and secondary object 100 may be generated by controller 66 to provide selectable distributed power settings. The user may then select an appropriate distributed power setting to reconfigure lead locomotive 20 as a trail locomotive. In one example, the user may select an "unlink and exit out of WDP lead mode" option to remove a locomotive from its lead designation (referring to FIG. 4). Other settings associated with other indicia may be possible. To complete the reconfiguration of lead locomotive 20 to a trail locomotive, the user may then select lead/trail object 92 to cause controller 66 to initiate the generation and transmission of reconfiguration commands, based on settings selected by the user, to the selected locomotive.

When configuring lead locomotive 20 to a trail locomotive, lead/trail object 92 may display indicia, such as text, to convey that selection of lead/trail object 92 is currently associated with a "set trail" command. In some embodiments, lead/trail object 92 may also be used to facilitate a "set lead" command when the user has selected a trail locomotive for reconfiguration as a lead locomotive. In such embodiments, controller 66 may be configured to automatically change the indicia associated with lead/trail object 92 to convey the "set lead" command.

Figure 7:
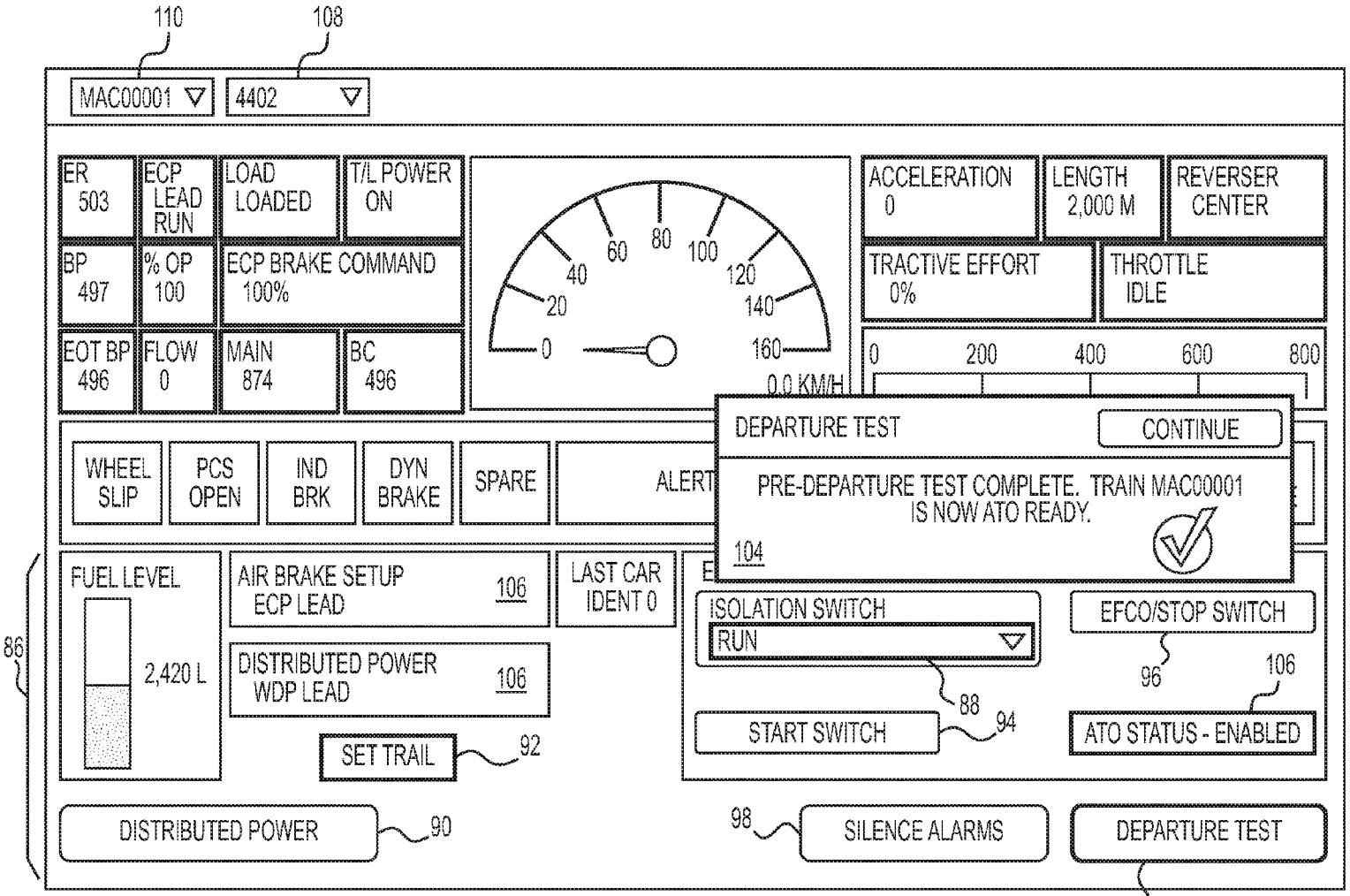
FIG. 7 is an exemplary graphical user interface that may be used in conjunction with the train control system of FIG. 1.

After the user selects lead/trail object 92, the selected locomotive (as indicated by locomotive selection object 108) may no longer be a lead locomotive and may be configured as a trail locomotive. Status object 106 may be automatically updated by controller 66 based on the settings selected by the user (i.e., based on whether a lead-to-trail or a trail-to-lead reconfiguration was made) to indicate a system status after the lead change has occurred. Although status object 106 in FIG. 7 shows the ATO status of the selected locomotive, other status objects showing other statuses, such as a distributed power status or an air brake setup status, may be included in GUI 78 and automatically updated as desired.

To reconfigure a trail locomotive as a lead locomotive, the user may then select a different locomotive 12 of train 10 via locomotive selection object 108 and adjust its associated control settings via GUI 78 using remote control device 58. For instance, after selecting a trail locomotive, the user may then change the distributed power setting via distributed power object 90 and/or secondary object 100 to an appropriate setting for reconfiguring the selected locomotive as a lead locomotive. In one example, the user may select a "link and enter WDP lead mode" option to give a locomotive the lead designation (referring to FIG. 4). Other settings associated with other indicia may be possible.

To complete the reconfiguration of a trail locomotive to a lead locomotive, the user may then select lead/trail object 92 to cause controller 66 to initiate the generation and transmission of reconfiguration commands, based on settings selected by the user, to the selected locomotive. When configuring a trail locomotive to a lead locomotive, lead/trail object 92 may display indicia, such as text, to convey that selection of lead/trail object 92 is currently associated with a "set lead" command, which may be changed subsequent to a successful lead change, as discussed above.

After the user selects lead/trail object 92, the selected locomotive (as indicated by locomotive selection object 108) may no longer be a trail locomotive and may be configured as a lead locomotive. Status object 106 may be automatically updated by controller 66 based on the settings selected by the user (i.e., based on whether a lead-to-trail or a trail-to-lead reconfiguration was made) to indicate a system status after the lead change has occurred. For instance, status objects 106, as shown in FIG. 6, may indicate that the selected locomotive is in a trail status, but may be updated upon completion of the lead change, as shown in FIG. 7 to indicate that the selected locomotive is in a lead status.

Before continuing the mission, the user may then select departure test object 102 to initiate a departure test of the selected locomotive. When the test is successful, controller 66 may generate test results object 104 to indicate that the test was successful and that the selected locomotive is ready to be operated under manual or ATO control. The user may then adjust the isolation switch setting of the selected locomotive by selecting a "run" status via isolation switch object 88 using input device 60 of remote control device 58. The user may then select start switch object 94 on GUI 78 to start engine 38 (referring to FIG. 2), as necessary, to allow the selected locomotive to produce power for continuing the mission.

Several advantages may be realized by the practice of the disclosed control system. In particular, the disclosed control system may allow managers of trains to remotely access individual control systems associated with multiple locomotives of a train in order to reconfigure locomotive control settings for successfully performing a locomotive lead change. The disclosed control system may allow managers to adjust control settings in each locomotive remotely, without requiring personnel to physically visit each locomotive while the train is stopped on the tracks. This may allow for faster locomotive reconfigurations and may allow for the reconfiguration of locomotives that are part of an autonomous train, which may have no onboard personnel.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary-only, with a true scope being indicated by the following claims and their equivalents.

The invention claimed is:

1. A control system for remotely facilitating a lead change among a plurality of locomotives in a train, the control system comprising:

a user input device a display device;

a communicating device configured to exchange information with the plurality of locomotives; and a controller in electronic communication with the user input device, the display device, and the communicating device, wherein the controller is configured to:

generate on the display device a graphical user interface configured to receive a plurality of user inputs in conjunction with the user input device, wherein the plurality of user inputs includes an isolation switch selection, a distributed power selection, and a lead/trail selection; and generate configuration commands communicable to the plurality of locomotives via the communicating device based on the plurality of user inputs, wherein the graphical user interface includes a set lead/trail object configured to provide a selectable set trail option or a selectable set lead option; and the lead/trail selection includes a user selection of one of the set trail and set lead options via the user input device.

2. The control system of claim 1, wherein:

the graphical user interface includes an isolation switch object configured to provide a plurality of selectable isolation switch settings; and the isolation switch selection includes a user selection of one of the plurality of isolation switch settings via the user input device.

3. The control system of claim 2, wherein the plurality of isolation switch settings includes an isolate setting and a run setting.

4. The control system of claim 1, wherein:

the graphical user interface includes a distributed power object configured to provide a plurality of selectable distributed power settings; and the distributed power selection includes a user selection of one of the plurality of distributed power settings via the user input device.

5. The control system of claim 4, wherein the plurality of distributed power settings includes a first setting corresponding to a desire to enter a distributed power lead mode and a second setting corresponding to a desire to exit the distributed power lead mode.

6. The control system of claim 1, wherein the controller is configured to selectively toggle the set lead/trail object between providing the selectable set trail option and providing the selectable set lead option.

7. The control system of claim 1, wherein the graphical user interface includes a departure test object, the departure test object corresponding to a desire to initiate a departure test and being selectable in conjunction with the user input device.

8. The control system of claim 1, wherein:

the graphical user interface includes a locomotive selection object configured to receive a selection of one of the plurality of locomotives in conjunction with the user input device; and the controller is configured to communicate the configuration commands to the selected one of the plurality of locomotives via the communicating device.

9. The control system of claim 1, wherein:

the graphical user interface includes one or more status objects indicative of a locomotive system status; and the controller is configured to automatically update the locomotive system status indicated by each of the one or more status objects based on the plurality of user inputs.

10. An apparatus for remotely facilitating a lead change among a plurality of locomotives in a train from a remote control device having a processor, the apparatus comprising:

a non-transitory computer-readable medium storing computer-readable instructions that, when executed by the processor of the remote control device, cause the processor to:

generate on a display device associated with the remote control device a graphical user interface configured to receive, in conjunction with a user input device associated with the remote control device, a plurality of user inputs, wherein the plurality of user inputs includes an isolation switch selection, a distributed power selection, and a lead/trail selection; and generate configuration commands communicable to the plurality of locomotives via a communicating device associated with the remote control device based on the plurality of user inputs, wherein the graphical user interface includes a set lead/trail object configured to provide a selectable set trail option or a selectable set lead option; and the lead/trail selection includes a user selection of one of the set trail and set lead options via the user input device associated with the remote control device.

11. The apparatus of claim 10, wherein:

the graphical user interface includes an isolation switch object configured to provide a plurality of selectable isolation switch settings; and the isolation switch selection includes a user selection of one of the plurality of isolation switch settings via the user input device associated with the remote control device.

12. The apparatus of claim 11, wherein the plurality of isolation switch settings includes an isolate setting and a run setting.

13. The apparatus of claim 10, wherein:

the graphical user interface includes a distributed power object configured to provide a plurality of selectable distributed power settings; and the distributed power selection includes a user selection of one of the plurality of distributed power settings via the user input device associated with the remote control device.

14. The apparatus of claim 13, wherein the plurality of distributed power settings includes a first setting corresponding to a desire to enter a distributed power lead mode and a second setting corresponding to a desire to exit the distributed power lead mode.

15. The apparatus of claim 10, wherein the graphical user interface includes a departure test object, the departure test object corresponding to a desire to initiate a departure test and being selectable in conjunction with the user input device associated with the remote control device.

16. The apparatus of claim 10, wherein:

the graphical user interface includes a locomotive selection object configured to receive a selection of one of the plurality of locomotives in conjunction with the user input device associated with the remote control device; and the computer-readable instructions, when executed by the processor of the remote control device, cause the processor to communicate the configuration commands to the selected one of the plurality of locomotives via the communicating device associated with the remote control device.

17. The apparatus of claim 10, wherein:

the graphical user interface includes one or more status objects indicative of a locomotive system status; and the computer-readable instructions, when executed by the processor of the remote control device, cause the processor of the remote control device to automatically update the locomotive system status indicated by each of the one or more status objects based on the plurality of user inputs.

18. A control system for remotely facilitating a lead change among a plurality of locomotives in a train, the control system comprising:

a plurality of locomotive control systems, each being associated with one of the plurality of locomotives in the train and configured to control a plurality of locomotive configuration settings; and a remote control device having:

a user input device;

a display device;

a communicating device configured to exchange information with the plurality of locomotive control systems; and a controller in electronic communication with the user input device, the display device, and the communicating device, wherein the controller is configured to:

generate on the display device a graphical user interface configured to receive a plurality of user inputs in conjunction with the user input device, wherein the plurality of user inputs includes an isolation switch selection, a distributed power selection, and a lead/trail selection; and generate configuration commands communicable to the plurality of locomotive control systems via the communicating device based on the plurality of user inputs, the configuration commands being indicative of a desired one or more of the plurality of locomotive configuration settings, wherein the graphical user interface includes a set lead/trail object configured to provide a selectable set trail option or a selectable set lead option; and the lead/trail selection includes a user selection of one of the set trail and set lead options via the user input device associated with the remote control device.

* * * * *